US005553433A

United States Patent [19]

Lang

[11] Patent Number: 5,553,433

[45] Date of Patent: Sep. 10, 1996

[54] FURRING APPARATUS AND METHOD FOR APPLYING SAME TO CYLINDRICAL COLUMNS

[76] Inventor: William M. Lang, 11 Shelter Harbor Ct., Wading River, N.Y. 11792

[21] Appl. No.: 174,329

[22] Filed: Dec. 30, 1993

[51] Int. Cl.[6] ..... E04C 3/30; E04B 1/94

[52] U.S. Cl. ..... 52/483.1; 52/DIG. 8; 52/733.2; 248/218.4; 248/219.1

[58] Field of Search ..... 29/401.1, 897.33; 52/728, 481.1, 479, 490, 745.12, DIG. 8, 483.1, 745.05, 745.09, 727; 248/218.4, 219.1

[56] References Cited

U.S. PATENT DOCUMENTS

| | | | |
|---|---|---|---|
| 443,897 | 12/1890 | Clark | 52/728 |
| 1,517,846 | 12/1924 | Lewis | 52/728 X |
| 1,598,592 | 4/1926 | Barrett | 29/728 X |
| 4,453,353 | 6/1984 | Killop et al. | 52/728 X |
| 4,976,084 | 12/1990 | Verbiar et al. | 52/713 |
| 5,218,802 | 6/1993 | Yoshimura et al. | 52/728 X |
| 5,222,344 | 6/1993 | Johnson | 52/728 |
| 5,335,471 | 8/1994 | Kupiel | 52/727 |

*Primary Examiner*—Joseph M. Gorski
*Attorney, Agent, or Firm*—Galgano & Burke

[57] ABSTRACT

A furring apparatus for cylindrical lolly columns includes a pair of generally triangular support members, each having two sides which define a pair of outer walls and a third side defining an inner wall and the latter also having a generally semicylindrical channel formed therein configured and dimensioned to allow receipt of the same about a cylindrical column in close fitting relationship thereto. The support members are hingeably secured together at one corner thereof so as to allow the same to be pivoted between a closed position in which the inner sides thereof abut one another and are disposed with their channels positioned to allow receipt of the same about a cylindrical column in close fitting relationship thereto, and an open position, in which said inner sides of said members are pivoted apart from one another. The support members are fastened together when in the closed position so as to permit the members to be securely fastened on the column. A method for applying the furring apparatus to a lolly column is also disclosed.

13 Claims, 1 Drawing Sheet

FURRING APPARATUS AND METHOD FOR APPLYING SAME TO CYLINDRICAL COLUMNS

BACKGROUND OF THE INVENTION

The present invention relates to a furring apparatus and method for applying the same to cylindrical columns.

Construction techniques are well known in the field for furring steel I-beams and round or cylindrical steel columns called "lolly" columns. Typically, the beam or column is boxed in by constructing a wooden or metal frame with so-called furring or furring strips or 2×4 dimensional lumber, and the frame is then covered with paneling or wallboard via nails or screws. The sizing, cutting and fastening of the furring to build the frame is both time consuming and labor-intensive, and is especially difficult for "do-it-yourself" homeowners.

Various attempts have been made to simplify this standard construction technique. For example, Crites et al, U.S. Pat. No. 4,592,187, discloses a method and apparatus for attaching furring to columns which employs L-shaped corner clips which serve as a frame support. However, the apparatus only appears suitable for I-beams and not lolly columns and, in addition, still requires many time-consuming construction steps and entails the use of various parts and pieces which must be properly fitted together. Verbiar, U.S. Pat. No. 4,976,084, provides an improved furring apparatus which is adaptable to both I-beams and lolly columns utilizing U-shaped members composed of two L-shaped members which fit about the column and engage one another in a telescopic manner. However, here too, thereof are numerous construction steps and the installer initially begins with groups of four straight members which must be bent about the column to be boxed in. This is particularly difficult for the typical "do-it-yourself" homeowner, especially when dealing with round lolly columns.

Accordingly, it is an object of the present invention to provide a novel furring apparatus and method for applying the same to round lolly columns especially intended for installation by novice installers or "do-it-yourself" homeowners.

It is a further object of the invention to provide such a novel method and device which is relatively simple in design and construction, economical to manufacture, and which reduces the number of installation steps as well as the time involved therein to significantly facilitate ease of installation.

SUMMARY OF THE INVENTION

Certain of the foregoing and related objects are readily attained in a furring apparatus for cylindrical or lolly columns which includes a pair of generally triangular support members, each having two sides which define a pair of outer walls joined at a first corner and a third side defining an inner wall joined at opposite ends to the first two sides at a second and third corner, respectively, with the third side having a generally semicylindrical channel formed therein configured and dimensioned to allow receipt of the same about a cylindrical column in close fitting relationship thereto. The apparatus further includes hinge means for hingeably securing the support members together at the second corners thereof so as to allow the members to be pivoted between a closed position in which the inner sides of the members abut one another and are disposed with their channels positioned to allow receipt of the same about a cylindrical column in close fitting relationship thereto, and an open position, in which the inner sides of the members and the third corners thereof are pivoted apart from one another. Fastening means are employed for fastening the support members together when in the closed position at a point adjacent to the third corners thereof so as to permit the members to be securely fastened on the column.

Preferably, the fastening meads comprises a screw and one of the support members has a hole formed therethrough extending from one of the outer walls to the inner wall thereof at a point adjacent to the third corner thereof.

Most advantageously, at least one of the semicylindrical channels has at least one recessed raceway formed therein and the triangular support members define right isosceles triangles with the first corners thereof being right angles. Most desirably, the support members are made of wood or plastic.

Certain of the foregoing and related objects are also attained in a method for applying furring to a cylindrical column, which includes the steps of providing a plurality of the aforementioned hinged and paired generally triangular support members successively positioning paired support members in the "open" position thereof at vertically spaced apart intervals on the cylindrical column to be framed and pivoting the same to the "closed" position thereof about the column in close fitting relationship thereto. The support members are then fastened together when in the closed position at a point adjacent to the third corners thereof so as to permit the members to be securely fastened on the column. Wall panels (i.e., drywall or paneling) may then be fastened to the outer walls of the support members.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
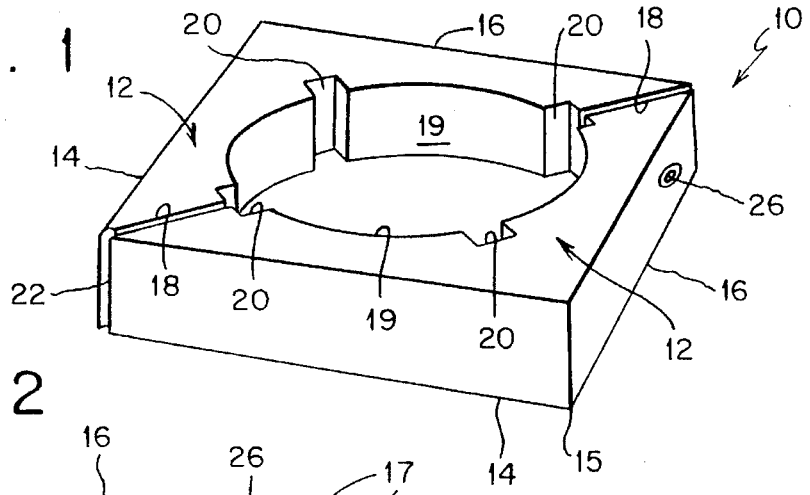
FIG. 1 is a perspective view of the novel furring apparatus embodying the present invention.
Figure 2:
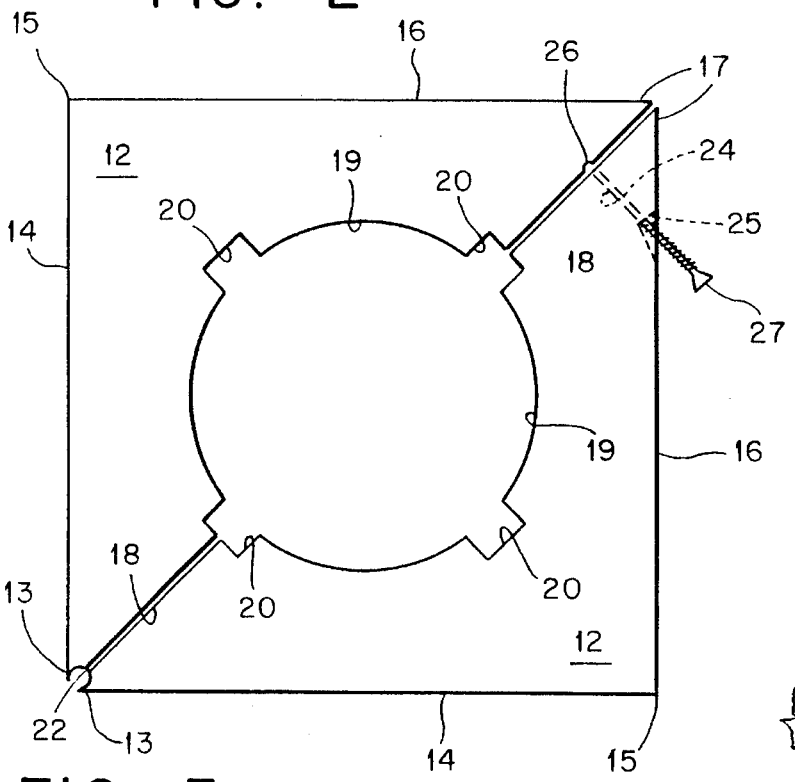
FIG. 2 is a top plain view of the apparatus shown in FIG. 1, further showing a fastening screw being used to fasten the support members of the furring apparatus together.

Referring now in detail to the appended drawing, therein illustrated is a novel furring apparatus 10 embodying the present invention which, as seen best in FIGS. 1 and 2, includes paired triangular support members 12, each of which has two outer sidewalls 14, 16 disposed at a right angle with respect to one another and joined together at corner 15, and an inner sidewall 18 joined at corners 13 and 17 to sides 14 and 16, respectively. Inner sidewall 18 has a semicylindrical channel 19 formed therein which, in turn, has a series of recessed raceway cut-outs or U-shaped channels 20 formed therein, for the receipt of electrical wiring, plumbing pipes and the like.

Figure 3:
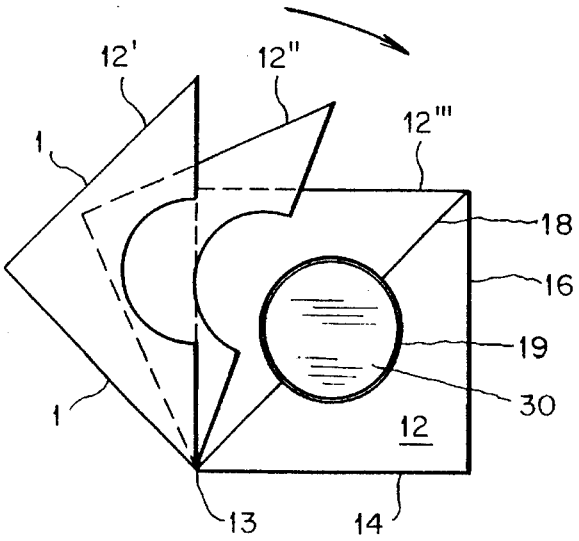
FIG. 3 is a sequential, schematic top plan view showing the pivotal movement of the support members from an open to closed position with respect to a lolly column.

Corners 13 of the paired support members 12 are joined together by a hinge 22 which comprises a reversed C-shaped flap or web of resilient material interconnecting corners 13 together in a flexible manner so as to allow for pivotal movement of support members 12 as shown in FIG. 3; hinge 22 may also comprise a conventional metal or plastic door hinge. The support members 12 are intended for pivotal movement about their corners 13 and 22 between an open position and a closed position with respect to a round lolly column 30. More particularly, one of the support members 12 is positioned so that its semicylindrical channel 19 abuts in close fitting relationship to lolly column 30 and then the other support member is pivoted from an open position 12' to an intermediate position 12" and finally to a closed position 12'" so that its semicylindrical channel 19 also abuts in a close fitting relationship lolly column 30 and the oppositely-disposed support member 12.

As seen best in FIG. 2, one of the support members 12 has a throughbore 24 formed therethrough extending from a recessed or countersunk hole opening 25 in outer wall 16 and opening onto a pilot hole 26 formed in the inner sidewall 18 of the oppositely-disposed support member 12. A drywall screw 27 is preferably employed to securely fasten the support members together adjacent to their free corners 17 via throughbore 24 and pilot hole 26 and to thereof lock or securely clamp support members 12 together about lolly column 30.

Figure 4:
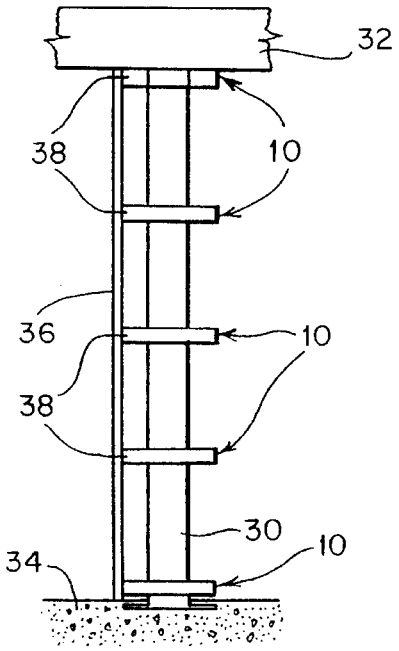
FIG. 4 is a side elevational view of a lolly column showing the furring apparatus installed thereon, in turn, supporting a sheet of drywall along one side thereof.

As shown in FIG. 4, preferably five paired support members 12 are used to frame a lolly column 30 which is shown supporting a horizontal header beam 32 about a concrete floor 34, as is typically found in many home basements.

To install the same, the homeowner simply needs one screw 27 per paired support members to clamp them in a vertically spaced apart manner on column 30 with their sides also being vertically aligned so as to provide a square-like frame to which wallboard 36 or paneling may be directly applied with paneling nails 38 or the like. Although only one side of the wallboard is shown installed, the same would be applied to the three other outer sides of the support members 10 to complete and finish the framing.

Various modifications may be made as will be apparent to those skilled in the art. For example, although the support members are preferably made of recycled injection molded plastic, wood or other composite materials could be employed. In addition, the dimensions and numbers of the paired support members and their raceways can, of course, be modified to suit the particular application and size of the lolly column to be framed.

Accordingly, while only one embodiment of the present invention has been shown and described, it is to be understood that many changes and modifications may be made thereunto without departing from the spirit and scope of the invention as disclosed herein.

What is claimed is:

1. A furring apparatus in combination with wallboard and a cylindrical column, comprising:

a plurality of means spaced along a cylindrical column for mounting said wallboard, with each of said means surrounding said column and secured thereon;

each said means comprising a pair of generally triangular support members, each having two sides which define a pair of outer walls joined at a first corner and a third side defining an inner wall joined at opposite ends to said first two sides at a second and third corner, respectively, said third side having a generally semicylindrical channel formed therein configured and dimensioned to allow receipt of the same about said cylindrical column in close fitting relationship thereto;

hinge means for hingeably securing said support members together at said second corners thereof so as to allow said members to be pivoted between a closed position in which said inner sides of said members abut one another and are disposed with said channels thereof positioned to allow receipt of the same about said cylindrical column in close fitting relationship thereto, and an open position, in which said inner sides of said members and said third corners thereof are pivoted apart from one another;

fastening means for fastening said support members together when in said closed position at a point adjacent to said third corners thereof so as to permit said members to be securely fastened on the column; and corresponding outer walls of said support members being aligned with each other and accommodating wallboard being mounted thereon.

2. The furring apparatus for cylindrical columns according to claim 1, wherein said fastening means comprises a screw.

3. The furring apparatus for cylindrical columns according to claim 2, wherein one of said support members has a hole formed therethrough extending from one of said outer walls to said inner wall thereof at a point adjacent to said third corner thereof.

4. The furring apparatus for cylindrical columns according to claim 1, wherein at least one of said semicylindrical channels has at least one recessed raceway formed therein.

5. The furring apparatus for cylindrical columns according to claim 1, wherein said triangular support members define right isosceles triangles with said first corners thereof being right angles.

6. The furring apparatus for cylindrical columns according to claim 1, wherein said support members are made of wood.

7. The furring apparatus for cylindrical columns according to claim 1, wherein said support members are made of plastic.

8. A furring apparatus for attaching wallboard to a cylindrical column, comprising:

a plurality of means positionable in a spaced apart manner along a cylindrical column for mounting wallboard thereon, with each of said means being configured to surround the column for securement thereon;

each said means comprising a pair of generally triangular support members, each having two sides which define a pair of outer walls joined at a first corner and a third side defining an inner wall joined at opposite ends to said first two sides at a second and third corner, respectively, said third side having a generally semicylindrical channel formed therein configured and dimensioned to allow receipt of the same about the cylindrical column in close fitting relationship thereto;

a raceway formed into the third side defining the semicylindrical channel, and extending from a top of said third side to a bottom of said third side hinge means for hingeably securing said support members together at said second corners thereof so as to allow said members to be pivoted between a closed position in which said inner sides of said members abut one another and are disposed with said channels thereof positioned to allow receipt of the same about the cylindrical column in close fitting relationship thereto, and an open position, in which said inner sides of said members and said third corners thereof are pivoted apart from one another;

fastening means for fastening said support members together when in said closed position at a point adjacent to said third corners thereof so as to permit said members to be securely fastened on the column; and corresponding outer walls of said support members being alignable with each other and accommodating the wallboard being mounted thereon.

9. The furring apparatus for use on a cylindrical column according to claim 8, wherein said fastening means comprises a screw.

10. The furring apparatus for use on a cylindrical column according to claim 9, wherein one of said support members has a hole formed therethrough extending from one of said outer walls to said inner wall thereof at a point adjacent to said third corner thereof.

11. The furring apparatus for use on a cylindrical column according to claim 8, wherein said triangular support members define right isosceles triangles with said first corners thereof being right angles.

12. The furring apparatus for use on a cylindrical column according to claim 8, wherein said support members are made of wood.

13. The furring apparatus for use on a cylindrical column according to claim 8, wherein said support members are made of plastic.

* * * * *